US005600888A

United States Patent [19]

Becker

[11] Patent Number: 5,600,888

[45] Date of Patent: Feb. 11, 1997

[54] ELECTRIC RAZOR

[75] Inventor: Klaus Becker, Mühlhausen, Germany

[73] Assignee: Payer Elecktroprodukte Gesellschaft m.b.H., Graz, Austria

[21] Appl. No.: 290,768

[22] PCT Filed: Feb. 17, 1993

[86] PCT No.: PCT/AT93/00023

§ 371 Date: Nov. 16, 1994

§ 102(e) Date: Nov. 16, 1994

[87] PCT Pub. No.: WO93/15883

PCT Pub. Date: Aug. 19, 1993

[30] Foreign Application Priority Data

Feb. 17, 1992 [AT] Austria ..... 269/92

[51] Int. Cl.[6] ..... B26B 19/02

[52] U.S. Cl. ..... 30/41.7; 30/43.92

[58] Field of Search ..... 30/41.7, 42, 43.9, 30/43.92; 340/568, 635

[56] References Cited

U.S. PATENT DOCUMENTS

| | | | |
|---|---|---|---|
| 4,112,271 | 9/1978 | Marchetti | 30/DIG. 1 X |
| 4,380,121 | 4/1983 | Naimer et al. | 30/42 |
| 4,408,392 | 10/1983 | Naimer | 30/34.1 |
| 4,719,698 | 1/1988 | Ninomiya et al. | 30/43.6 |
| 5,240,107 | 8/1993 | Casale | 30/41.7 X |
| 5,347,715 | 9/1994 | Friedland | 30/41.7 |

FOREIGN PATENT DOCUMENTS

| | | | |
|---|---|---|---|
| 0432849 | 6/1991 | European Pat. Off. . | |
| 2486856 | 1/1982 | France . | |
| 1168796 | 4/1964 | Germany . | |
| 3714109 | 11/1988 | Germany . | |
| 3910373 | 10/1990 | Germany . | |
| 3-218791 | 9/1991 | Japan . | |
| 4-336092 | 11/1992 | Japan | 30/42 |
| 2080590 | 2/1982 | United Kingdom . | |

OTHER PUBLICATIONS

*Patent Abstracts of Japan;* Publication No. JP3218791; vol. 15, No. 497; Matsushita Electric Works Ltd.; Dec. 16, 1991.

*Patent Abstracts of Japan;* Publication No. JP4105685; vol. 16, No. 346; Matsushita Electric Works Ltd.; Jul. 27, 1992.

*Patent Abstracts of Japan;* Publication No. JP54110062; vol. 3, No. 134; Tokyo Electric Co. Ltd.; Nov. 9, 1979.

*Patent Abstracts of Japan;* Publication No. JP2144093; vol. 14, No. 384; Matsushita Electric Works Ltd.; Aug. 20, 1990.

*Primary Examiner*—Hwei-Siu Payer

*Attorney, Agent, or Firm*—Longacre & White

[57] ABSTRACT

An electric razor having a cutter foil and a cutter head, which interacts with the cutter foil and is driven by a motor which is electronically pulsed. An indicating device is provided which is connected to an operating time counter and/or to a device for detecting the load on the cutter foil and to an evaluation circuit, as a result of which increased safety can be achieved in use of the razor by timely indication of cutter foil wear.

8 Claims, 2 Drawing Sheets

ELECTRIC RAZOR

FIELD OF THE INVENTION

The invention relates to an electric razor having a cutter foil and a cutter head which interacts with the cutter foil and is driven by a motor which is possibly electronically pulsed, and having an indicating device to recommend foil replacement.

DESCRIPTION OF THE PRIOR ART

In the case of such razors, which are known in various configurations, for example with a rotating or oscillating cutter head, the operating reliability and the shaving result are to a large extent dependent on the two mutually interacting parts which are intended to result in the facial hairs being cut off. In addition to the blades of the head, which are naturally subject to a certain amount of wear, the cutter foil is primarily of critical importance to the desired result. Cutter foils have a limited life, the risk of injury significantly increasing towards the end of the life of the cutter foils, and it no longer being ensured that the facial hairs are cut off smoothly. The risk of injury in this case increases not least because the originally specified geometrical shape of the openings in the cutter foil is no longer exactly maintained and, even when the apparatus is switched off, sharp-edged projections on the edge of the openings in the cutter foils can provide a cause of injuries.

In the case of an electric razor which is disclosed in DE-B-1,168,796, the cutter foil can adapt itself to the surface to be shaved and to the cutter head blade.

JP-A-3,218,791 has already disclosed such a razor, in which an indicating device is connected to an operating time counter in order to produce a recommendation for foil replacement. An operating time count on the basis of an autonomous oscillator, for example of a commercially available clock module, allows the operating time to be determined as a function of the on and off switch of the razor, and hence only a relatively coarse estimate of the actual wear of the cutter foil.

The wear to which the cutter foil is subjected is in this case dependent on the friction between the cutter foil and the sharpening block which moves in a positively locked manner relative to the cutter foil. Depending on the contact pressure of the cutter foil which is selected by the respective user by operating the apparatus, the foil is now matched on the one hand to the contour of the face surface to be shaved and on the other hand to the contour of the cutter head, as a result of which the wear is also highly dependent on the load and on the way in which the respective user uses the razor.

SUMMARY OF THE INVENTION

The invention now has the object of creating an electric razor of the type mentioned initially, which is intended to ensure better estimation of the actual wear of the cutter foil and can produce a corresponding cutter foil replacement recommendation in order considerably to reduce the risk of injury to the user of the razor. In order to achieve this object, the razor according to the invention and of the type mentioned initially comprises an indicating device being connected to a device for detecting the load on the cutter foil and to an evaluation circuit. Alternatively, when using a pulsed motor, an improvement can be achieved by the indicating device being connected to an operating time counter, which is triggered by the pulsing of the motor, and to an evaluation circuit. Such an indicating device, when it emits a corresponding signal, provides the user with a recommendation for foil replacement and thus ensures that excessively worn cutter blades are also no longer used. The identification to the user of a razor of the correct time at which a cutter foil should be replaced is not directly measurable or possible since a defective cutter foil is primarily identified by injuries which have already occurred. However, as a result of such an indicating device according to the present invention, the time at which injuries could occur is now reliably indicated in advance, and the possibility is created of replacing a cutter foil even before any injury is possible.

An improved estimate of the actual wear of the cutter foil results if the operation of the indicating device also includes an evaluation of other operating parameters of the razor, for example the power consumption or the like. The operating time count is thus advantageously combined with a device for detecting the load on the cutter foil and with an evaluation circuit, it being possible for such a device for detecting the load on the cutter foil and an evaluation circuit to produce correct information for triggering the indicating device irrespective of a pure operating time count, as well. Alternatively, the design according to the invention can in this case be implemented such that the operating time counter is triggered by the pulsing of the motor, a combined statement on the load on the cutter foil being possible just by means of such a link between the time count and the pulsing of the motor.

The design according to the invention is implemented in a particularly advantageous manner in that the device for detecting the load on the cutter foil is formed by a current consumption measurement apparatus whose measurements are connected to the indicating device via an evaluation circuit, especially an integrator. The integrated current consumption directly provides the capability of producing a recommendation to replace the cutter foil independently of the time which has actually passed, the integration of the current consumption naturally being effected via the current consumption in the unit time.

The design according to the invention can also be implemented in a particularly simple manner in that the device for detecting the load on the cutter foil comprises pressure sensors which interact with the cutter foil, such detection of pressure measurements additionally taking account of the most common operator parameters in using the electric razor i.e., motor load compared to foil/cutter pressure.

In the case of electric razors, it has now become normal, particularly in the case of the respective top of the range model, to provide indications of the remaining capacity of an accumulator. In the present invention, use of such a remaining capacity indication is linked to a certain amount of electronic complexity which, without any additional cost, makes possible particularly simple generation of the corresponding signals for the indicating device to recommend the foil replacement. In such cases, the design of the present invention is implemented in a particularly advantageous manner, in that a change in the battery voltage or accumulator voltage in operation is evaluated as the signal for detecting the load on the cutter foil.

Such an indicating device which provides information on the necessity to replace the foil can be cancelled again in various ways. The invention is in this case advantageously implemented by it being possible to cancel the indicating device via a switching contact which resets the counter, the switching contact preferably being mechanically coupled to the cutter foil and it being possible to operate it automatically when the cutter foil is replaced. Particularly when the switching contact is mechanically coupled to the cutter foil, resetting and cancellation are effected immediately after the replacement of the cutter foil. The design can in this case be implemented in a particularly simple manner such that the counting or evaluation circuit which is connected to the indicating device has a settable and resettable flipflop, which can be set by the counting or evaluation circuit and can be reset by a switching contact, as a result of which the requirement is also satisfied with very little electronic complexity.

The invention is explained schematically in the following text, with reference to two block diagrams in the drawing.

DETAILED DESCRIPTION

Figure 1:
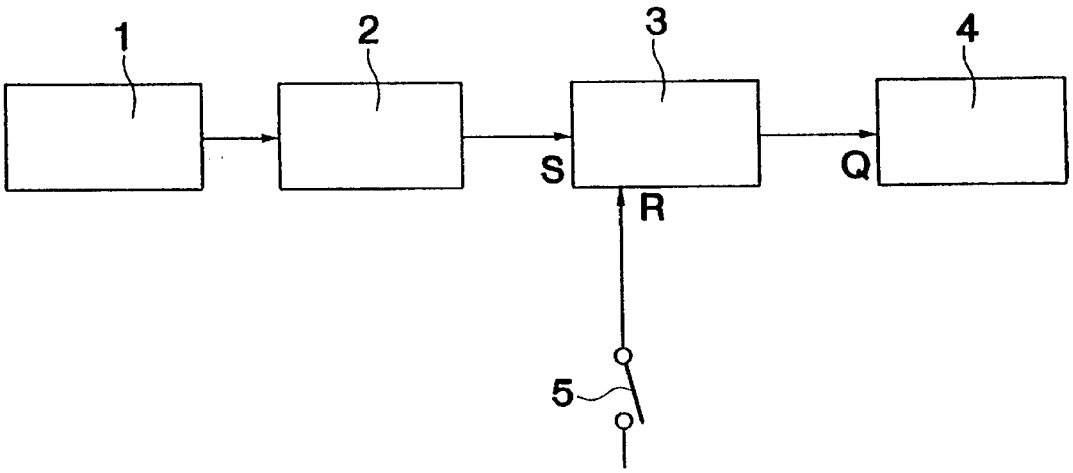
FIG. 1 shows a first design of the circuit arrangement with a simple counting device; and, FIG. 2 shows a schematic illustration of the combination of the evaluation of motor pulsing and oscillator signals.

In FIG. 1, 1 schematically indicates the motor pulsing. The motor pulse or a clock signal is fed to a time counter 2, the output signals being passed to the indicating device 4 via a resettable flipflop 3. Connected to the resettable flipflop 3 is an external switching contact, indicated schematically by 5, which brings about resetting of the flipflop and hence of the indicator or of the indicating device 4. In the simplest case, the indicating device 4 can be formed by an LED or a suitable symbol on an LCD.

In the design in FIG. 1, the time count can be implemented in the simplest case such that the corresponding indication is produced on the indicator 4 after, for example, 30 or 35 operating hours.

In FIG. 1, reference S represents the output signal time counter, reference R represents the reset signal, and reference Q represents the output signal flip flop.

Figure 2:
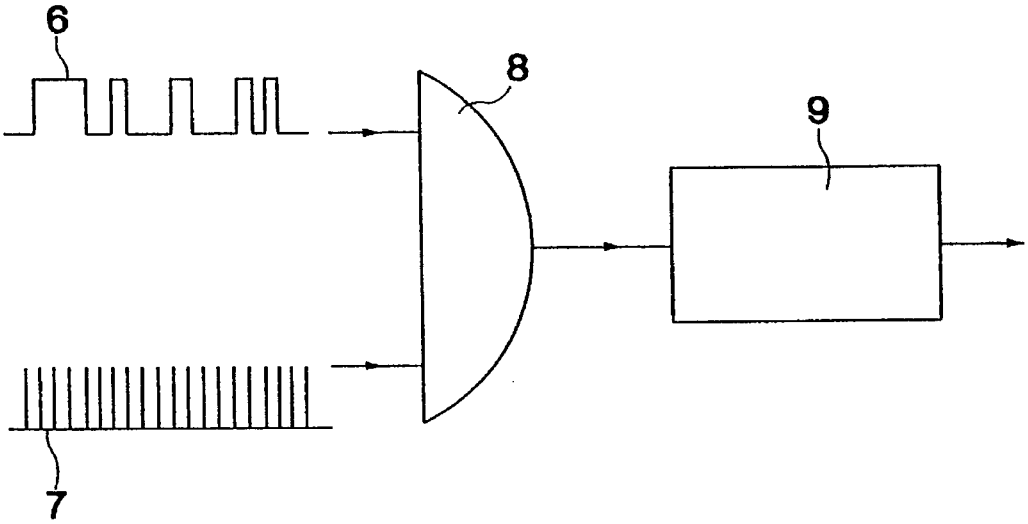

In FIG. 2, the motor pulsing is indicated schematically by the pulse sequence 6. At the same time, 7 indicates schematically the pulse waveform of the oscillator signals. The signals, which in this way exist in parallel, are supplied to an AND module 8 and from there are evaluated in a counter 9. The linking of the motor pulsing to the oscillator in this way also allows the load state to be identified and only the signals linked in this manner are supplied to the counter 9 and from there to the flipflop 3 or to the indicator 4, as was illustrated in FIG. 1.

While the foregoing description of the invention has been provided for in an essentially schematic form, it is considered entirely enabling to one of ordinary skill in the razor field and one being familiar with conventional razors. For example the present invention can readily be adapted to the razors disclosed in U.S. Pat. No. 4,719,698 to Ninomiya, U.S. Pat. No. 4,380,121 to Naimer, and U.S. Pat. No. 4,408,392, also to Naimer. Each of the foregoing U.S. patents is incorporated herein in their entirety by reference thereto.

The essential feature for reliable operation of the design according to FIG. 2 is that the oscillator frequency is selected to be considerably higher than the pulse frequency of the motor.

Figure 4:
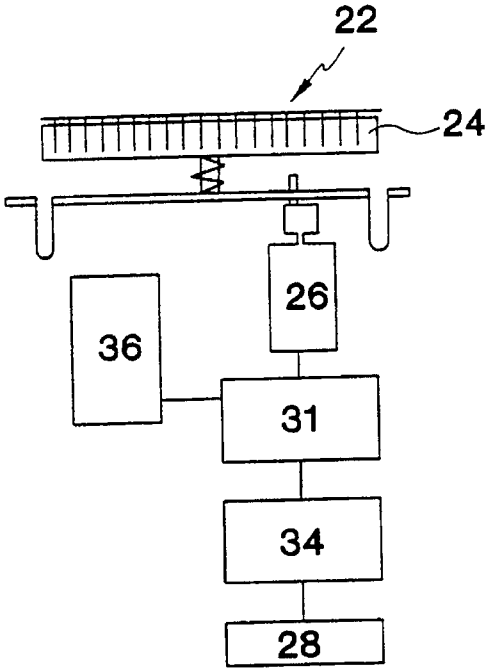
FIG. 4 is a schematic representation of the circuitry of the instant invention having a motor, battery, load detection circuit, and an indication means.
Figure 3:
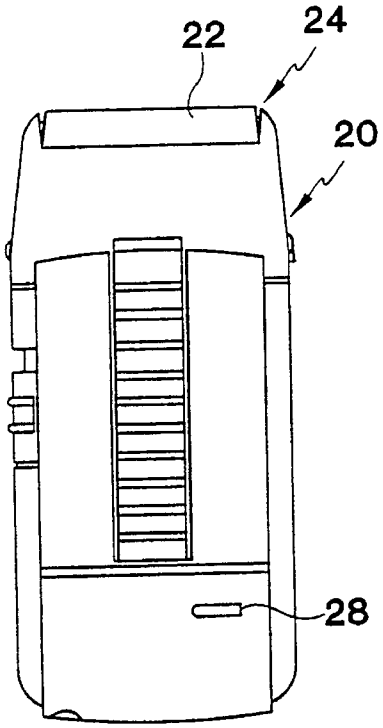
FIG. 3 is a front view of an electric shaver having a foil replacement indicator.

FIG. 3 illustrates an electric razor 20 having a cutter foil 22 and a cutter head 24 which interacts with the cutter foil 22. As shown in FIG. 4, the cutter head 24 is driven by an electric motor 26.

An indicating device 28 to recommend cutter foil replacement is connected to a device for detecting the load on the cutter foil 22 and to an evaluation circuit 34.

Figure 5:
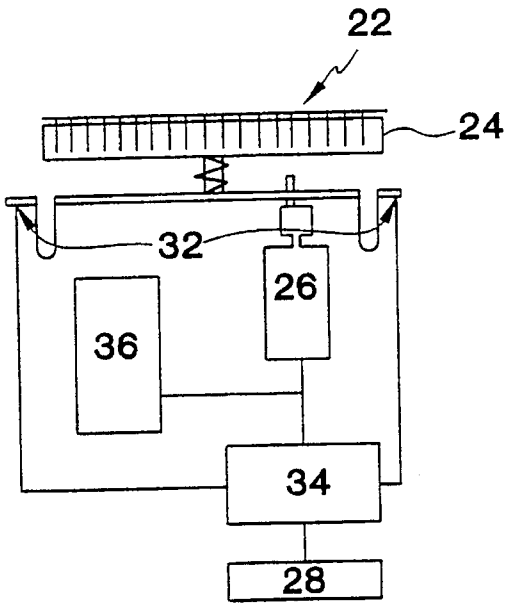
FIG. 5 is a schematic representation of the circuitry of the instant invention having a motor, battery, pressure sensors and an indication means.

The load detecting device may take several forms. For example, the indicating device 28 may be connected to load detection circuit 31 comprising an operating time counter for the razor 20, which is triggered by the pulsing of the motor 26, and to the evaluation circuit 34. In addition, the load detection circuit may include includes a current consumption measurement apparatus whose measurements are connected to the indicating device 28 through the evaluation circuit 34, wherein the evaluation circuit 34 further comprises an integrator. Moreover, load detecting device may comprise pressure sensors 32 (see FIG. 5) which interact with and sense pressure on the cutter foil 22.

As shown in FIG. 4, the razor 20 includes a battery 36 on an accumulation and a change in the battery voltage or an accumulator voltage in operation of said razor is evaluated as the signal for detecting the load on the cutter foil. The counting or evaluation circuit 34 which is connected to the indicating device 28 has a settable and resettable flipflop, which can be set by the counting or evaluation circuit and can be reset by a switching contact mechanically coupled to the cutter foil 22. The switching contact can be operated automatically when the foil 22 is replaced.

I claim:

1. An electric razor comprising:

a cutter foil and a cutter head which interacts with the cutter foil and is driven by an electric motor; and, an indicating device to recommend cutter foil replacement, said indicating device being connected to a device for detecting the load on the cutter foil and to an evaluation circuit.

2. An electric razor comprising:

a cutter foil and a cutter head which interacts with the cutter foil and is driven by an electrically pulsed motor; and, an indicating device to recommend foil replacement, said indicating device being connected to an operating time counter for said razor, which is triggered by the pulsing of the motor, and to an evaluation circuit.

3. A razor according to claim 1: wherein said device for detecting the load on the cutter foil includes a current consumption measurement apparatus whose measurements are connected to said indicating device through said evaluation circuit, said evaluation circuit further comprising an integrator.

4. A razor according to claim 1: wherein, said device for detecting the load on the cutter foil comprises pressure sensors which interact with and sense pressure on the cutter foil.

5. A razor according to claim 1: wherein said razor includes a battery on an accumulation and a change in the battery voltage or an accumulator voltage in operation of said razor is evaluated as the signal for detecting the load on the cutter foil.

6. A razor according to claim 2, wherein:

said indicating device can be cancelled via a switching contact which resets said counter.

7. A razor according to claim 6, wherein:

said switching contact is mechanically coupled to said cutter foil and can be operated automatically when said cutter foil is replaced.

8. A razor according to claim 6, wherein:

said evaluation circuit which is connected to said indicating device has a settable and resettable flipflop, which can be set by the evaluation circuit and can be reset by said switching contact.

* * * * *